United States Patent [19]

Juds et al.

[11] Patent Number: 4,976,346

[45] Date of Patent: Dec. 11, 1990

[54] COIN COUNTER SECURITY CIRCUIT

[75] Inventors: Scott Juds, Everett, Wash.; Johnny H. Halsey; James H. Halsey, both of ElDorado, Ark.

[73] Assignee: IDX, Inc., El Dorado, Ark.

[21] Appl. No.: 299,184

[22] Filed: Jan. 19, 1989

[51] Int. Cl.[5] ..... G07F 9/02

[52] U.S. Cl. ..... 194/200; 194/219

[58] Field of Search ..... 194/200, 202, 223, 217, 194/218

[56] References Cited

U.S. PATENT DOCUMENTS 4,347,925 9/1982 Sugimoto et al. ..... 194/200

*Primary Examiner*—F. J. Bartuska

*Attorney, Agent, or Firm*—Diller, Ramik & Wight

[57] ABSTRACT

A coin counter security circuit for use in vending machines having a counter for counting the number of vending transactions. The circuit functions to detect indicia of proper counter operation (and hence that the counter has not been improperly disconnected) and serves to enable the vend transaction when proper counter operation has been so detected. The indicia of proper counter operation can be the detection of a flyback signal normally generated by an inductive element associated with the counter.

8 Claims, 2 Drawing Sheets

FIG. 1
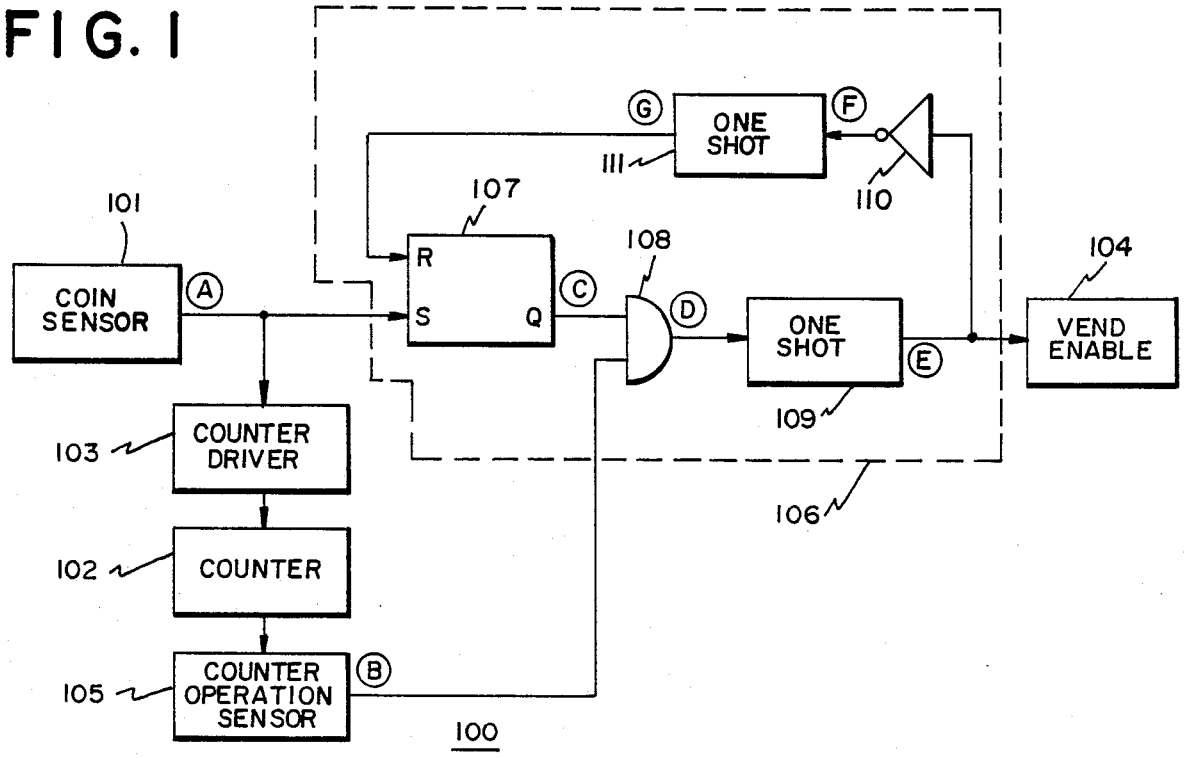
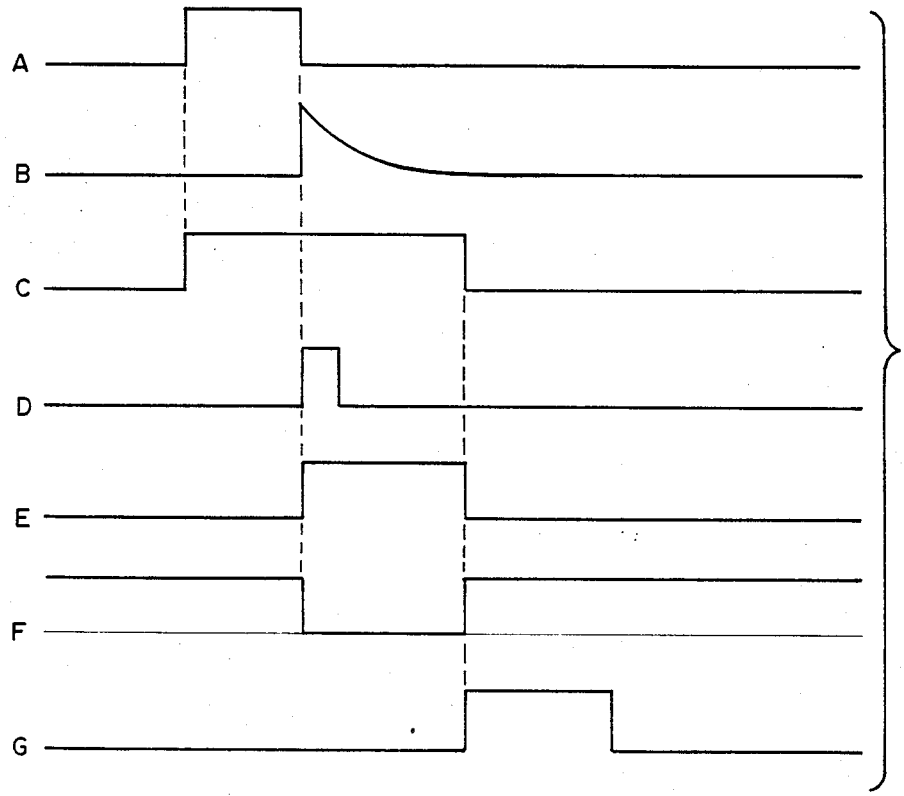
FIG. 2

COIN COUNTER SECURITY CIRCUIT

TECHNICAL FIELD

This invention relates generally to coin operated vending machines, and particularly to security circuits for use with such machines.

BACKGROUND ART

Coin operated vending machines are well known in the art. Such machines provide needed goods and/or services in locations where it would not be economically feasible to otherwise provide traditionaly manned and stocked retail facilities. Such machines generally require the purchaser to insert money (paper bills or coins) into an input device and then provide the purchaser with a particular product or service as selected by the purchaser.

The money placed into the machine will usually be held in a locked area within the machine, and the machine's owner or representative will visit the machine from time to time and withdraw the collected money. Unfortunately, persons retained by the owner to perfrom this task are not universally honest, and some such persons occassionally divert part of the collected funds to themselves. This, of course, defrauds the owner of money rightfully earned on his behalf by the vending machine.

As a partial solution, some vending machines can be purchased or otherwise equipped with a counter to count vending transactions. The owner can then compare the accumulated count from the counter with receipts collected by his employees from time to time to ascertain the accuracy with which the employees are collecting and submitting such funds.

Unfortunately, such counters are usually easily temporarily disconnected by a dishonest individual who wishes to make the vending machine appear to be making fewer sales then in fact it is, to thereby allow him to divert the receipts from the hidden sales to himself. A need therefore exists for a means of determining whether such a counter has been disconnected, and for preferably responding in a way that will likely induce the individual to reconnect the counter and cease his dishonest activities.

SUMMARY OF THE INVENTION

These needs and others are substantially met through provision of the coin counter security circuit disclosed herein. This circuit operates in conjunction with a vending machine having a coin sensor, a vend enable circuit and a counter for counting vends. The invention itself includes a counter operation sensor and a control circuit for preventing the vending machine from completing a vend when the counter has been disconnected.

In one embodiment, the counter includes a solenoid for triggering the count mechansim (such as a mechanical counter), and the counter operation sensor functions by detecting the flyback signal that normally appears at the conclusion of the count cycle when the enabling power is removed from the solenoid. If the flyback signal cannot be sensed, the control circuit functions to prevent the vend enable circuit from continuing the vend transaction. The purchaser will then retrieve his money from the machine, and no vend will occur.

In effect, then, a dishonest individual stands nothing to gain by disconnecting the counter to conceal his thefts because once disconnected, no further vends will take place. The motive for engaging in this particular dishonest activity is therefore greatly reduced.

BRIEF DESCRIPTION OF THE DRAWINGS

These and other attributes of the invention will become more clear upon making a thorough and complete review of the following description of the best mode for carrying out the invention, particularly when reviewed in conjunction with the drawings, wherein:

FIG. 1 comprises a block diagram depiction of the invention in conjunction with relevant protions of a vending machine;

FIG. 2 comprises timing diagrams that relate to the functioning of the invention.

BEST MODE FOR CARRYING OUT THE INVENTION

Figure 3:
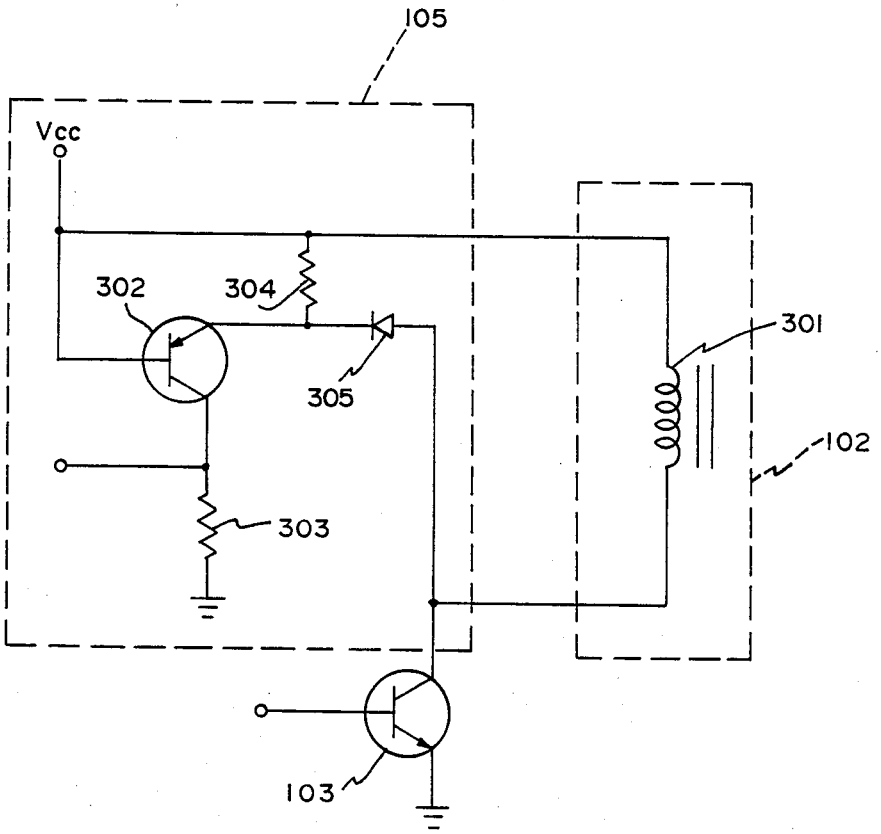
FIG. 3 comprises a schematic detailed depicton of the counter operation sensor circuit.

Referring now to the drawings, and in particular to FIG. 1, the invention can be seen as generally depicted by the numeral 100. The invention (100) operates in conjunction with a vending machine's coin sensor (101), counter (102), counter driver (103), and vend enable circuity (104). The invention (100) itself generally includes a counter operation sensor (105) and a control circuit (106). These elements will be described below in more detail.

The coin sensor (101) typically comprises a mechanical and electrical device for sensing the presence of an appropriate amount of money. In this particular embodiment, it will be presumed that the coin sensor (101) provides as its output, in the presence of a correct amount of money, a pulse as depicted in FIG. 2A.

The output of the coin sensor (101) connects to a counter driver (103), which provides an output signal having an adequate voltage (and/or current as appropriate) to the counter (102). In this embodiment, it will be presumed that the counter (102) includes a solenoid triggered counting mechansim.

The counter operation sensor (105) couples to the counter (102) (as explained below in more detail) and provides an output signal as depicted in FIG. 2B at the conclusion of the solenoid energization cycle. If the solenoid has been previously energized to effectuate the counting function, the counter operation sensor (105) will provide the indicated output. If the solenoid has not been so energized (when, for example, the counter solenoid has been disconnected by a dishonest individual), the counter operation sensor (105) will not cause the indicated output signal to issue.

The output of the coin sensor (101) and the output of the counter operation sensor (105) are then provided to the control circuit (106). More particularly, the output of the coin sensor (101) may connect, for example, to the set input of a flip-flop (107), the Q output of which connects to one input of a two-input AND gate (108) (this Q output can be seen as depicted in FIG. 2C). The remaining input of the AND gate (108) connects to receive the output of the counter operation sensor (105). So configured, the AND gate (108) will provide an output only when both the counter operation sensor (105) and the flip-flop (107) are providing outputs to it (presuming a normal operating cycle, a representative output for the AND gate (108) can be seen depicted in FIG. 2D).

The AND gate (108) connects to the trigger port of a one shot monostable vibrator (109), such that provision of an input pulse to the one shot (109) as depicted in FIG. 2D will cause provision of an output pulse having a fixed duration as depicted in FIG. 2E. This output pulse is provided to the vend enable circuitry (104) of the vending machine to allow the vend to continue, and also through a series connected invertor (110) and second one shot (111) to the reset port of the flip-flop (107). A representative output signal from the invertor (110) can be seen in FIG. 2F, and a representative output signal from the second one shot (111) can be seen in FIG. 2G.

It can therefore be seen that a vend enable signal will be provided to the vend enable circuit (104) when and only when the counter operation sensor (105) detects indicia that the counter has in fact operated in a normal manner, and that the coin sensor has sensed appropriate coinage. Disconnection of the counter will of course disrupt this required configuration, and the necessary vend enable signal will not be generated.

With reference to FIG. 3, a more detailed description of the counter operation sensor (105) will now be provided.

The counter driver (103) is comprised in this embodiment of a transistor that, when switched on, allows current to flow from a source through the solenoid (301) of the counter (102). When the enabling signal to the driver transistor terminates, this path will be disrupted. Since current will not instantly cease flowing through an inductor (such as the solenoid (301), a flyback voltage will develop across the indicated resistor (304). This flyback signal is used to trigger a transistor (302) and thereby cause a voltage to appear across a resistor (303) attached to the collector thereof. This voltage comprises the output signal of the counter operation sensor (105) described above.

The depicted circuit also includes a diode (305) to ensure proper protection of the transistor (302) during various operating modes of the circuit.

Numerous modifications and alterations to this described embodiment will occur to those skilled in the art. Such modifications and alterations should not be considered as outside the scope of the claims in the absence of express limitations directed to the precise embodiments set forth.

We claim:

1. A coin counter security method for use with a vending machine having a coin sensor, an accumulated vend counter for counting the number of vending transactions, and vend enable means for enabling a vending transaction, the method comprising the steps of:

(A) monitoring said accumulated vend counter to detect times when said accumulated vend counter has been active;

(B) detecting when said accumulated vend counter has been active in conjunction with proper coinage being sensed by said coin sensor;

(C) in response to said detecting step, enabling said vend enable means to enable said vending transaction.

2. The method of claim 1 wherein said accumulated vend counter includes a solenoid that must be energized to increment its count, and wherein said step of monitoring includes the step of detecting a flyback signal originated by said solenoid when said solenoid is deenergized.

3. The method of claim 2 wherein said monitoring step includes providing a transistor that switches active states only as a function of the presence and absence of said flyblack signal.

4. A coin counter security device for use with a vending machine having a coin sensor, an accumulated vend counter for counting the number of vending transactions, and vend enable means for enabling a vending transaction, comprising:

(A) counter operation sense means for detecting when said accumulated vend counter has been active;

(B) logic means responsive to said counter operation sense means and said coin sensor for providing a signal when said accumulated vend counter has been active in conjunction with a detection of proper coinage by said coin sensor, which signal is provided to said vend enable means to allow said vending transaction to continue.

5. The device of claim 4 wherein said accumulated vend counter includes a solenoid that becomes energized when said accumulated vend counter increments, and wherein said counter operation sense means includes switch means for switching conductive states in response to the presence and absence of a flyback signal as generated by said solenoid.

6. The device of claim 5 wherein said switch means includes a transistor that switches on and off as a function of said flyback signal.

7. A coin counter security method for use with a vending maching having a coin sensor, an accumulated vend counter for counting the number of vending transactions, and vend enable means for enabling a vending transaction, the method comprising the steps of:

(A) monitoring said accumulated vend counter to detect operable presence of the accumulated vend counter;

(B) detecting when said accumulated vend counter has been operably present in conjunction with proper coinage being sensed by said coin sensor;

(C) in response to said detecting step, enabling said vend enable means to enable said vending transaction.

8. The method of claim 7 wherein the step of detecting when said accumulated vend counter has been operably present includes the step of detecting that the accumulated vend counter has been active in conjunction with proper coinage being sensed by said coin sensor.

* * * * *